United States Patent [19]

Melzi

[11] Patent Number: 4,870,790

[45] Date of Patent: Oct. 3, 1989

[54] STRUCTURE FOR GARAGING MOTOR VEHICLES

[75] Inventor: Omar Melzi, Bergamo, Italy

[73] Assignee: The Dynamic Energy Research S.R.l., Bergamo, Italy

[21] Appl. No.: 200,492

[22] Filed: May 31, 1988

[30] Foreign Application Priority Data

Jun. 5, 1987 [IT] Italy ..... 84941 A/87

[51] Int. Cl.[4] ..... E04H 6/42

[52] U.S. Cl. ..... 52/175

[58] Field of Search ..... 52/33, 65, 66, 174–176, 52/169.2, 169.3, 169.4, 236.3; 414/228, 233, 262, 263

[56] References Cited

U.S. PATENT DOCUMENTS

| | | | |
|---|---|---|---|
| 1,452,426 | 4/1923 | Irwin | 414/233 |
| 2,695,716 | 11/1954 | Graham | 52/175 X |
| 2,818,607 | 1/1958 | Maissen | 52/176 |
| 3,670,464 | 6/1972 | Cutter | 52/30 |
| 4,697,392 | 10/1987 | Silze | 52/65 |

FOREIGN PATENT DOCUMENTS

| | | | |
|---|---|---|---|
| 1382038 | 12/1964 | France | 52/176 |
| 479949 | 4/1953 | Italy | 414/263 |
| 1047448 | 11/1966 | United Kingdom | 414/263 |

*Primary Examiner*—David A. Scherbel
*Assistant Examiner*—Jerrold D. Johnson
*Attorney, Agent, or Firm*—Guido Modiano; Albert Josif

[57] ABSTRACT

A structure for garaging motor vehicles such as cars comprising a plurality of circular crown-shaped carousels mounted for rotation with respect to each other about a vertical axis. Driving means and control means maintain the carousels in rotation at mutually differential speeds. Each carousel has fixed thereto a plurality of radial sectors arranged sequentially and partially superimposed to define a saw-toothed configuration comprising a plurality of planes inclined arranged to accommodate at least one row of motor vehicles at a narrowest interior portion thereof closest to the axis of rotation. The sectors are spaced apart to allow the passage of motor vehicles from one sector to an adjacent one. One or more entrances are provided at the top of the structure for access to a radial section of the uppermost carousel passing the entrance. Motor vehicles can then be driven downwardly to lower carousels along a substantially helical path to an exit at the base of the structure.

4 Claims, 3 Drawing Sheets

STRUCTURE FOR GARAGING MOTOR VEHICLES

BACKGROUND OF THE INVENTION

The present invention relates to a structure for garaging motor vehicles.

It is a well known fact that the great increase in the number of motor vehicles has given rise to severe technical and urbanistic problems regarding the provision of parking areas, within town limits or at town boundaries, which can accommodate a large number of motor vehicles. Solutions proposed heretofore are not entirely satisfactory: car parks or parking lots have a very limited capacity, and even multi-story car parks do not fully exploit all of the available space.

SUMMARY OF THE INVENTION

The main object of the present invention is to provide a structure for garaging motor vehicles which permits both the greatest possible exploitation of the available space and rapidity of parking.

This object and others which will become more apparent hereinafter are achieved by a structure for garaging motor vehicles according to the invention, which comprises a plurality of carousels mounted for rotation one with respect to the other about a vertical axis and delimiting a corresponding number of superimposed horizontal planes, a plurality of radial sectors supported by each carousel and arranged radially one after the other, but each lying offset with respect to the other, thereby being inclined with respect to the direction of rotation of the carousel, at least one entrance port for the motor vehicles provided at an upper fixed entrance plane, driving means and control means for rotating said carousels for permitting motor vehicles to be sequentially transferred in descent from one carousel to another along a substantially helical path to an exit at the base of the structure.

Advantageously, the driving means and the control means rotate the carousels at reciprocally differential speeds to successively align each inclined radial section of one carousel with all of the inclined radial sectors of an underlying carousel, so as to permit a motor vehicle to be driven between the entrance and the exit along a helical path, the relative speed of the carousels being set to assure a time interval of substantial alignment between two inclined sectors on two adjacent carousels which is sufficient to permit the transfer of a motor vehicle from one plane to the underlying one.

BRIEF DESCRIPTION OF THE DRAWINGS

Further features and advantages of the invention will better appear from the following detailed description of a preferred but not exclusive embodiment thereof, with reference to the accompanying drawings, in which.

DESCRIPTION OF THE PREFERRED EMBODIMENTS

Figure 1:
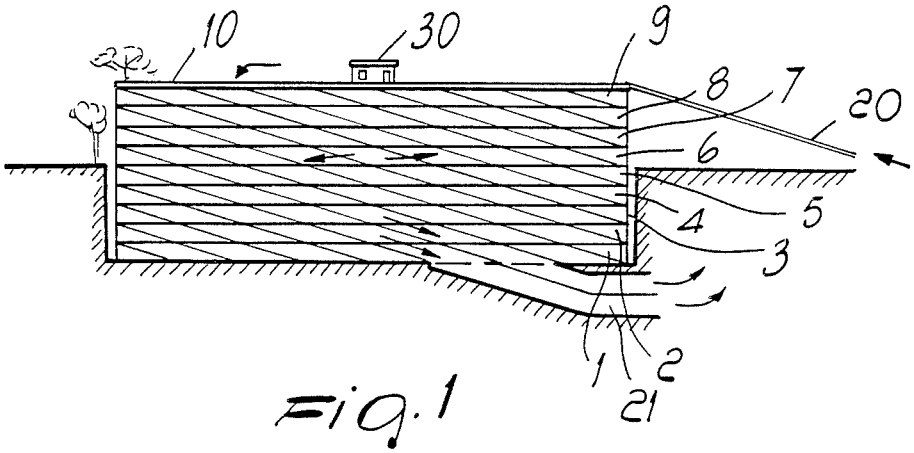
FIG. 1 is an elevation view of a structure according to the invention.
Figure 2:
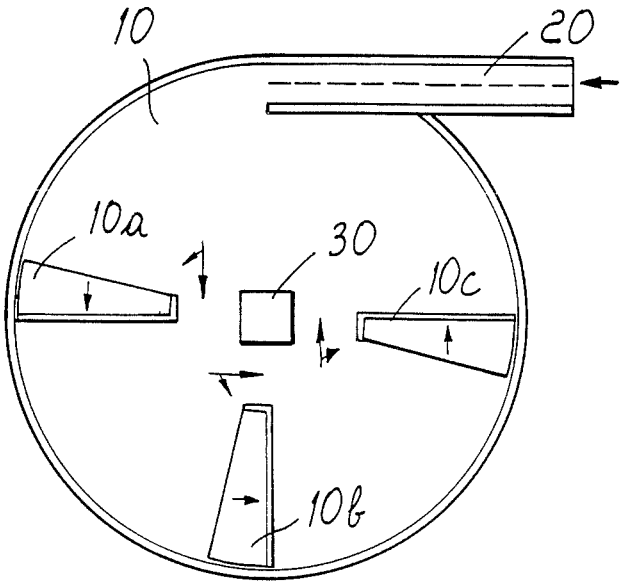
FIG. 2 is a top plan view of the structure of FIG. 1.
Figure 4:
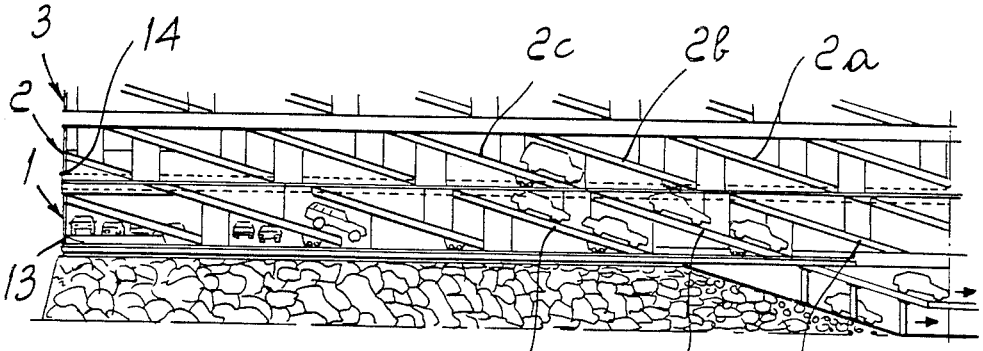
FIG. 4 is a detail elevation view of the structure of FIG. 3.

With reference to the above described FIGURES, the reference numerals 1 to 9 indicate nine superimposed carousels defining nine planes in a partly subterranean structure having a fixed cover or top roof 10.

Each carousel has the form of a circular crown comprising a plurality of modular radial sectors arranged on offset inclined planes and being connected to define a saw-toothed configuration, indicated by the reference numerals 1*a*, 1*b*, and 1*c* for the carousel 1, and by the reference numerals 2*a*, 2*b*, and 2*c*, for the carousel 2.

Figure 3:
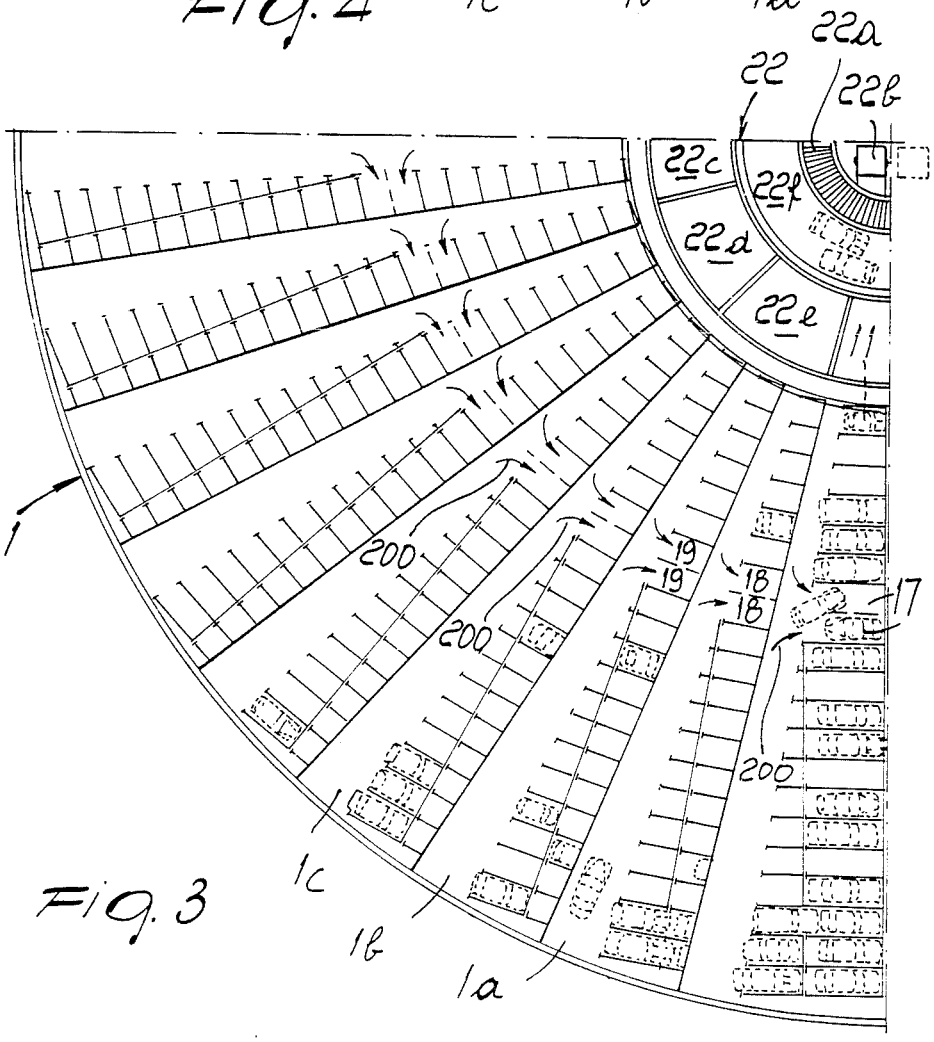
FIG. 3 is an enlarged scale plan view of one quarter of the structure of FIGS. 1 and 2.

Each inclined plane has a width so as to permit, as shown in FIG. 3, garaging of at least one row of motor vehicles 11 at the narrowest internal part, whilst at the larger external part it will be possible to accommodate even two aligned rows of motor vehicles such as cars. The various modular radial sectors are partly superimposed and spaced apart such that between two consecutive planes there remains sufficient space for the passage of the motor vehicles.

Each carousel has wheels 12*a*, 12*b* resting on a circumferential rail indicated by the reference numeral 13 for the carousel 1, and by the numeral 14 for the carousel 2, and each carousel expediently has at least two rails arranged, for example, at the maximum and minimum circumferences thereof. Driving means, generally indicated at 30, are also provided for causing rotation of each carousel about a common vertical axis, such means comprising, for example, a toothed circumferential crown operatively engaged by pinions actuated by at least a pair of electric motors, one of which is a reserve motor.

The speeds of rotation of the various carousels can be reciprocally differentiated (e.g. through computerized control means) so as to determine alignment in succession of each of the inclined planes of one carousel with all of the inclined planes of the underlying carousel, such that a given motor vehicle can move along a helical path to find an unoccupied space. The movement of the carousels is governed to allow the passage of the motor vehcicle to an underlying plane or floor.

Figure 5:
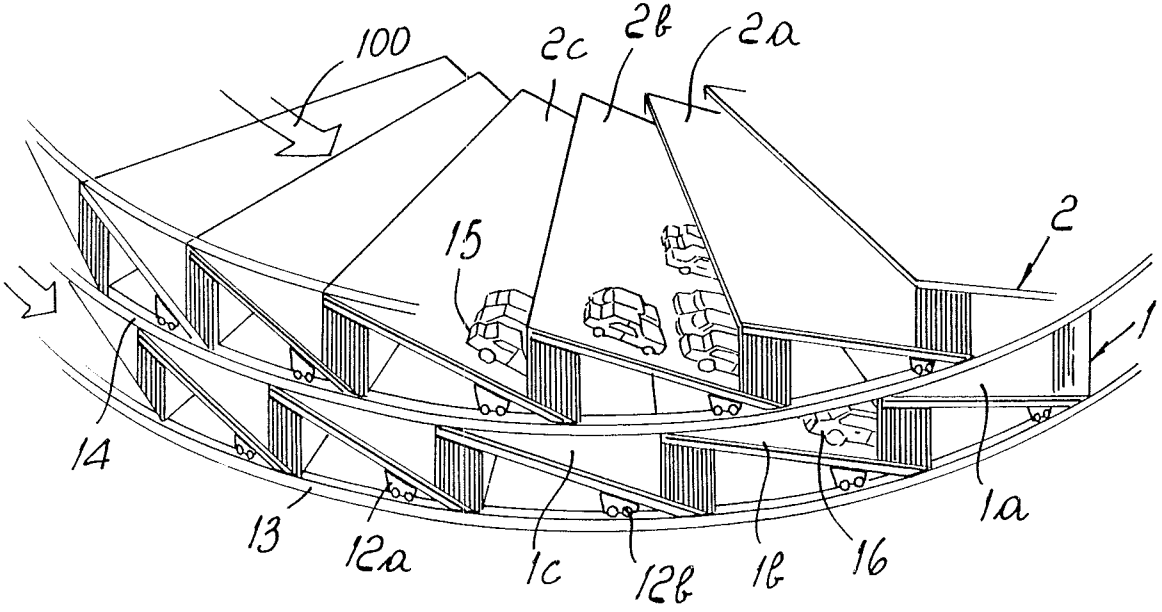
FIG. 5 is an elarged scale view of a portion of two superimposed motor-driven carousels.

Thus, for example, if the car indicated by the reference numeral 15 in FIG. 5, parked at the outside of the inclined plane 2*c* of the second carousel 2, has to be driven out of the car park, the driver waits until the rotational movement of the second carousel 2 in the direction of the arrow 100, occurring at a faster speed than the rotational movement of the first carousel 1, brings the inclined plane 2*c* into alignment with the plane 1b of said first carousel 1, whereat the driver will see that the car 15 cannot be moved because of the presence of another car 16 parked on the plane 1*b*, and thus awaits the alignment of the plane 2*c* with the plane 1*a* which, being unoccupied, permits the car 15 to be driven to the exit.

In normal conditions, sooner or later each motor vehicle can be driven downwardly along a helical path along the different inclined planes. Anyway, given the hypothesis that this was not possible due to other cars occupying all of the inclined planes of an underlying carousel, or due to the malfunctioning or breakdown of some components of the structure, there are provided alternative paths, indicated by the reference numerals 17 on the plane 1*a*, 18 on the plane 1*b*, and 19 on the plane 1*c*, which must always be maintained clear, as may be indicated by appropriate signs. The alternative paths can be followed by cars driven radially along the sectors or inclined planes in the direction of the arrows 200 in FIG. 3.

Good signposting will facilitate users during parking, manoeuvring and exit, and may comprise, as well as the signs on the inclined planes shown in FIG. 3 for delimiting parking spaces and alternative paths, also monitor equipment and traffic lights.

Motor vehicles can be driven in any of the entrances 10*a*, 10*b*, or 10*c* open at the top cover or roof 10, which can be reached from ground level by driving along a ramp 20. The entrances give access to the inclined planes of the upper carousel 9, and thus motor vehicles can be parked either on the inclined planes of the carousel 9 or driven downwards to be parked on a carousel at a lower level wherever there is a free space, moving in a helical path as described heretofore.

The exits from the structure are indicated by the reference numeral 21.

In the space at the interior of the structure is a tower or column, generally indicated by the reference numeral 22, which functions as a load-bearing axle for the carousels. Services can be provided in the tower, such as stairs 22*a*, lifts 22*b* for the users who, after having parked their cars, walk across the inclined planes, and for users returning to their cars. Other services may also be provided such as a supermarket 22*c*, restaurant 22*d*, automobile service station 22*e*, public service terminals 22*f*, and the like.

It will be understood that the above-described structure provides garaging for a considerable number of motor vehicles in a relatively small space.

It should be emphasized that the inclined planes on which the motor vehicles are parked permit the exit to be reached by gravity, even by motor vehicles which cannot be started, thereby avoiding creating an obstruction or reducing the car parking capacity of the structure.

The above-described invention is susceptible to numerous modifications and adaptations within the scope of the claims. Thus, for example, in car park structures intended to garage motor vehicles for a number of days, or in the case of breakdown of the control means or the driving means, the carousels can remain located in alignment. In this case, the motor vehicles can be moved along the helical bands which then define an uninterrupted path from the top to the base of the structure.

Obviously, while reference has been made herein to a partially subterranean structure, the structure can be constructed also entirely above, or entirely below ground level.

I claim:

1. A structure for garaging motor vehicles comprising:

a plurality of carousels mounted for rotation about a common vertical axis of rotation and defining a radial direction and a rotation direction, each of said carousels lying in an horizontal plane and comprising a plurality of radial sectors, said radial sectors extending along said radial direction and being inclined with respect to said horizontal plane, each of said sectors having an upper rim and a lower rim, said sectors being furthermore arranged in a partially overlapping configuration and being adapted to accomodate motor vehicles arranged in a substantially perpendicular direction with respect to said radial direction, said plurality of carousels comprising at least an upper carousel and a lower carousel, said upper carousel having upper sectors and said lower carousel having lower sectors;

an entrance provided at said upper carousel, on top of said structure, to permit a motor vehicle to accomodate in one of said upper sectors;

driving means and control means for rotating said carousels so that each of said upper sectors can be brought in correspondence of one of said lower sectors, the lower rim of said upper sector being adjacent to the upper rim of said lower sector, a motor vehicle being thereby able to move from said upper sector to said lower sector;

an exit provided at said lower carousel to permit a motor vehicle to clear said lower sector.

2. A structure, according to claim 1, wherein said rotation has a different speed for each of said carousel, each of said upper sectors being brought in correspondance with each of said lower sector successively, the speed of each of said carousels being selected such that the time interval during which an upper sector is in correspondance with a lower sector is sufficient to ensure a safe passage of a motor vehicle from upper to lower sectors.

3. A structure, according to claim 1, wherein said driving means comprises a toothed circumferential crown for each of said carousels, said crown being engaged by a pinion oprated by a motor, each of said carousels comprising wheels moving on supporting circumferential rails provided in said structure.

4. A structure, according to claim 1, further comprising a central column acting as load bearing axle for said carousels and locating a plurality of accessory services.

* * * * *